US010349693B2

(12) United States Patent
Anderson et al.

(10) Patent No.: US 10,349,693 B2
(45) Date of Patent: Jul. 16, 2019

(54) APPAREL PROTECTING DEVICE

(71) Applicants: David Anderson, Estacada, OR (US); Ellen Anderson, Estacada, OR (US)

(72) Inventors: David Anderson, Estacada, OR (US); Ellen Anderson, Estacada, OR (US)

( * ) Notice: Subject to any disclaimer, the term of this patent is extended or adjusted under 35 U.S.C. 154(b) by 44 days.

(21) Appl. No.: 15/653,099

(22) Filed: Jul. 18, 2017

(65) Prior Publication Data

US 2019/0021421 A1 Jan. 24, 2019

(51) Int. Cl.
*A45F 5/02* (2006.01)
*A41D 27/12* (2006.01)

(52) U.S. Cl.
CPC ..... *A41D 27/12* (2013.01); *A45F 5/022* (2013.01)

(58) Field of Classification Search
CPC ..... A41D 27/20; A45F 5/02; A45F 5/022
See application file for complete search history.

(56) References Cited

U.S. PATENT DOCUMENTS 5,038,985 A * 8/1991 Chapin ..... A47F 7/143 224/669
5,388,741 A * 2/1995 Hillinger ..... A45F 5/02 206/349
5,450,994 A 9/1995 Malinowski
6,131,779 A * 10/2000 Gendala ..... A45F 5/02 224/148.1
6,189,153 B1 2/2001 Diamond
6,659,321 B2 12/2003 Hartranft
D492,469 S 7/2004 Broxholm
9,198,498 B2 12/2015 Stevens, IV
10,070,713 B1 * 9/2018 Carver ..... A45F 5/02
2004/0124220 A1 * 7/2004 Blechman ..... A45F 5/02 224/162
2006/0015987 A1 1/2006 Anderson
2007/0180726 A1 * 8/2007 Harrell ..... A45F 5/02 33/760
2011/0139837 A1 6/2011 Davis
2016/0322844 A1 * 11/2016 Pickens ..... H02J 7/0044
2018/0255912 A1 * 9/2018 Carver ..... A45F 5/02

* cited by examiner

*Primary Examiner* — Tajash D Patel

(57) ABSTRACT

An apparel protecting device for isolating a pocket from a tool attached to the pocket includes a panel. A fold is positioned in the panel and defines a first section of the panel, a second section of the panel, and a slot that is positioned between the first section and the second section. The second section is configured to be inserted into a pocket of an article of clothing to position the first section on an exterior of the pocket. The panel is configured to be inserted into a clip of a tool, such as a tape measurer, to couple the tool to the panel. The first section is configured to be positioned between the tool and the pocket to isolate the tool from the pocket to prevent damage to the article of clothing.

9 Claims, 3 Drawing Sheets

APPAREL PROTECTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98

The disclosure and prior art relates to protecting devices and more particularly pertains to a new protecting device for isolating a pocket from a tool attached to the pocket.

BRIEF SUMMARY OF THE INVENTION

An embodiment of the disclosure meets the needs presented above by generally comprising a panel. A fold is positioned in the panel and defines a first section of the panel, a second section of the panel, and a slot that is positioned between the first section and the second section. The second section is configured to be inserted into a pocket of an article of clothing to position the first section on an exterior of the pocket. The panel is configured to be inserted into a clip of a tool, such as a tape measurer, to couple the tool to the panel. The first section is configured to be positioned between the tool and the pocket to isolate the tool from the pocket to prevent damage to the article of clothing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
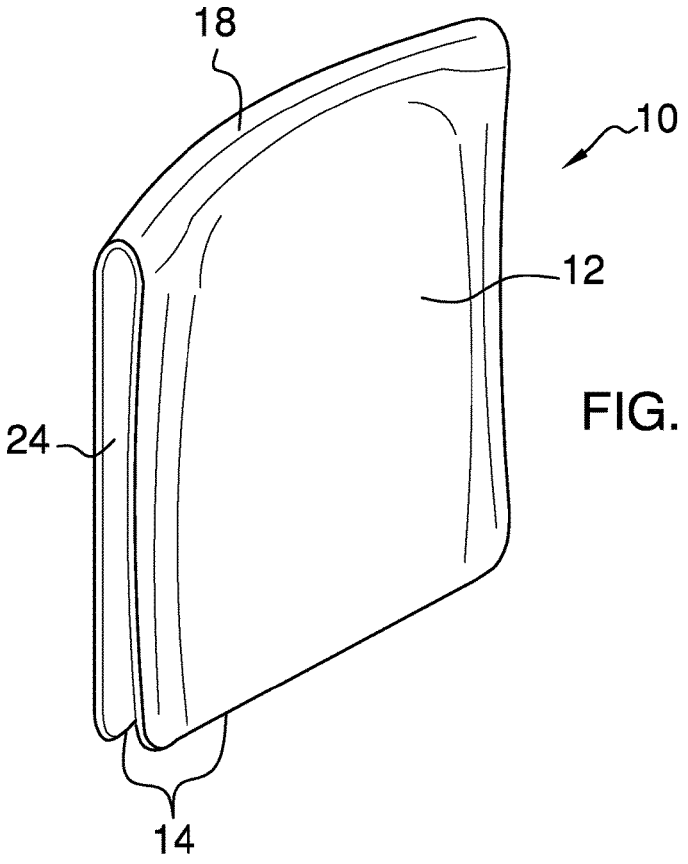
FIG. 1 is an isometric perspective view of an apparel protecting device according to an embodiment of the disclosure.
Figure 2:
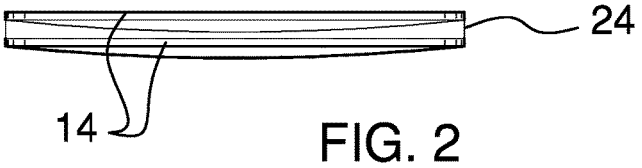
FIG. 2 is a bottom view of an embodiment of the disclosure.
Figure 3:
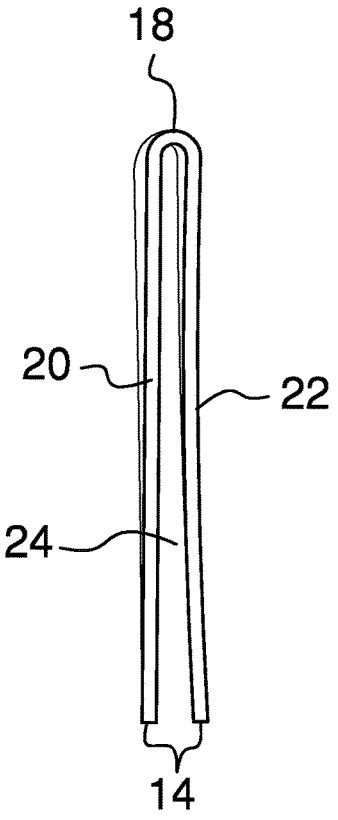
FIG. 3 is a side view of an embodiment of the disclosure.
Figure 4:
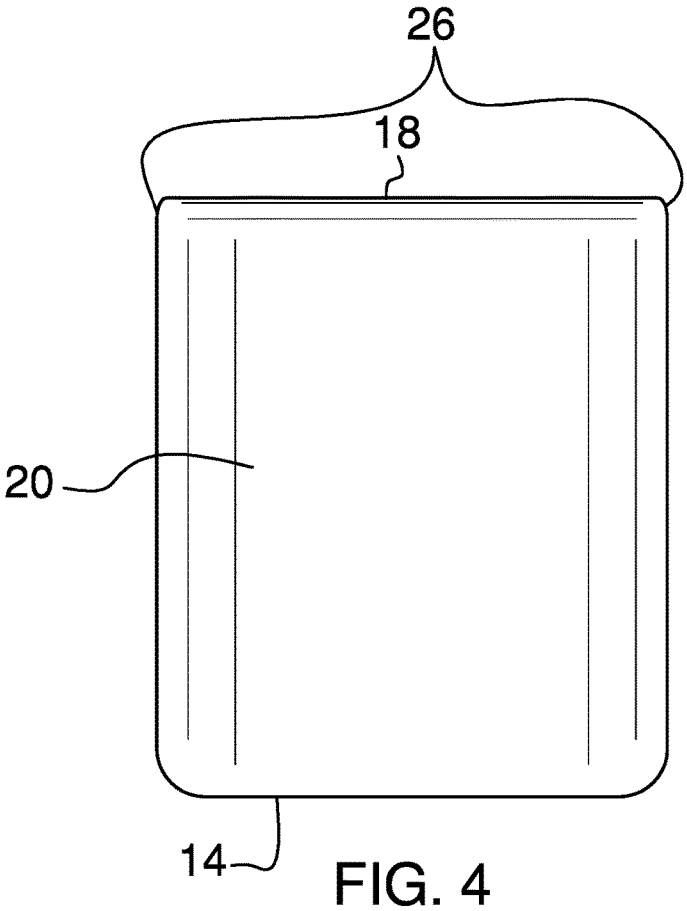
FIG. 4 is a front view of an embodiment of the disclosure.
Figure 5:
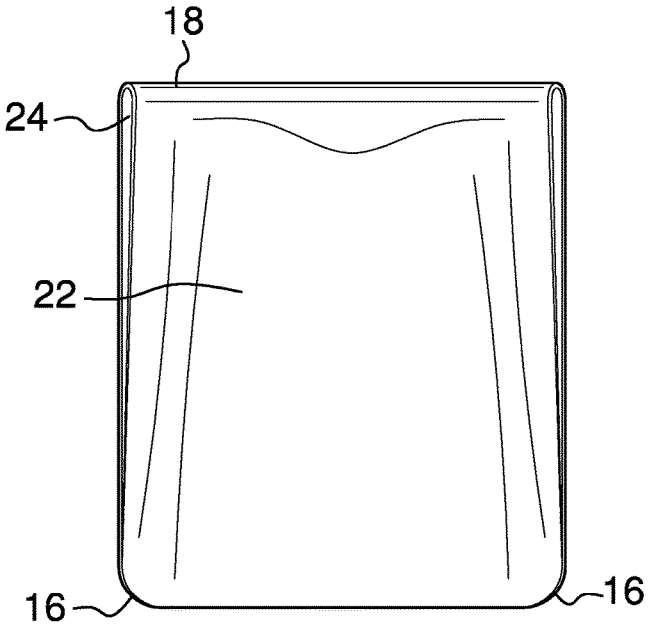
FIG. 5 is a back view of an embodiment of the disclosure.
Figure 6:
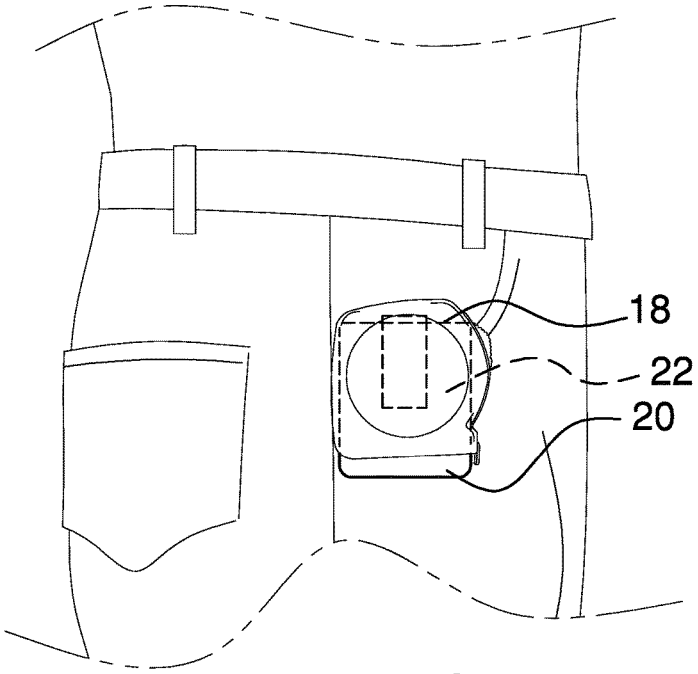
FIG. 6 is an in-use view of an embodiment of the disclosure.

With reference now to the drawings, and in particular to FIGS. 1 through 6 thereof, a new protecting device embodying the principles and concepts of an embodiment of the disclosure and generally designated by the reference numeral 10 will be described.

As best illustrated in FIGS. 1 through 6, the apparel protecting device 10 generally comprises a panel 12. The panel 12 is dimensioned such that a respective opposing end 14 of the panel 12 is configured to be inserted into a pocket of an article of clothing. In one embodiment, the panel 12 is substantially rectangularly shaped. The panel 12 has corners 16. In another embodiment, the corners 16 are rounded. In yet another embodiment, the panel 12 comprises plastic.

A fold 18 is positioned in the panel 12 and defines a first section 20 of the panel 12, a second section 22 of the panel 12, and a slot 24 that is positioned between the first section 20 and the second section 22. The second section 22 is configured to be inserted into the pocket of the article of clothing to position the first section 20 on an exterior of the pocket. The panel 12 is configured to be inserted into a clip of a tool, such as a tape measurer, to couple the tool to the panel 12. The first section 20 is configured to be positioned between the tool and the pocket to isolate the tool from the pocket to prevent damage to the article of clothing.

In one embodiment, the fold 18 is positioned equally distant from the opposing ends 14 of the panel 12. The opposing ends 14 are proximately positioned. In another embodiment, the fold 18 is arcuate. The slot 24 is substantially U-shaped when viewed from a respective opposing side 26 of the panel 12. In yet another embodiment, the fold 18 extends arcuately between the opposing sides 26 of the panel 12. The first section 20 and the second section 22 are arcuate proximate to the fold 18.

In use, the second section 22 is configured to be inserted into the pocket of the article of clothing to position the first section 20 on the exterior of the pocket. The panel 12 is configured to be inserted into the clip of the tool, such as the tape measurer, to couple the tool to the panel 12. The first section 20 is configured to be positioned between the tool and the pocket to isolate the tool from the pocket to prevent the damage to the article of clothing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An apparel protecting device comprising:

a panel, said panel having oppositely facing planar surfaces;

a fold positioned in said panel defining a first section of said panel, a second section of said panel, and a slot positioned between said first section and said second section; and wherein said fold is positioned in said panel such that said second section is configured for inserting into a pocket of an article of clothing positioning said first section on an exterior of the pocket, an outwardly facing surface of said first section being smooth such that said panel is configured for inserting into a clip of a tool for coupling the tool to said panel such that said first section is configured for positioning between the tool and the pocket for isolating the tool from the pocket for preventing damage to the article of clothing.

2. The device of claim 1, further including said panel being dimensioned such that a respective opposing end of said panel is configured for inserting into the pocket of the article of clothing.

3. The device of claim 2, further including said panel being substantially rectangularly shaped.

4. The device of claim 3, further including said panel having corners, said corners being rounded.

5. The device of claim 1, further including said panel comprising plastic.

6. The device of claim 1, further including said fold being positioned equally distant from opposing ends of said panel such that said opposing ends are proximately positioned.

7. The device of claim 1, further including said fold being arcuate such that said slot is substantially U-shaped when viewed from a respective opposing side of said panel.

8. The device of claim 1, further including said fold extending arcuately between opposing sides of said panel such that said first section and said second section are arcuate proximate to said fold.

9. An apparel protecting device comprising:

a panel, said panel being dimensioned such that a respective opposing end of said panel is configured for inserting into a pocket of an article of clothing, said panel being substantially rectangularly shaped, said panel having corners, said corners being rounded, said panel comprising plastic, said panel having oppositely facing planar surfaces;

a fold positioned in said panel defining a first section of said panel, a second section of said panel, and a slot positioned between said first section and said second section, wherein said fold is positioned in said panel such that said second section configured for inserting into the pocket of the article of clothing positioning said first section on an exterior of the pocket, an outwardly facing surface of said first section being smooth such that said panel is configured for inserting into a clip of a tool for coupling the tool to said panel such that said first section is configured for positioning between the tool and the pocket for isolating the tool from the pocket for preventing damage to the article of clothing, said fold being positioned equally distant from said opposing ends of said panel such that said opposing ends are proximately positioned, said fold being arcuate such that said slot is substantially U-shaped when viewed from a respective opposing side of said panel, said fold extending arcuately between said opposing sides of said panel such that said first section and said second section are arcuate proximate to said fold; and wherein said fold is positioned in said panel such that said second section configured for inserting into the pocket of the article of clothing positioning said first section on the exterior of the pocket such that said panel is configured for inserting into the clip of the tool for coupling the tool to said panel such that said first section is configured for positioning between the tool and the pocket for isolating the tool from the pocket for preventing the damage to the article of clothing.

* * * * *